US007188995B2

(12) United States Patent
Besse et al.

(10) Patent No.: US 7,188,995 B2
(45) Date of Patent: Mar. 13, 2007

(54) TOURBILLON

(75) Inventors: Laurent Besse, Villers le Lac (FR); Robert E. A. Jansen, Zug (CH)

(73) Assignee: Wtach -U-License AG (CH)

( * ) Notice: Subject to any disclaimer, the term of this patent is extended or adjusted under 35 U.S.C. 154(b) by 0 days.

(21) Appl. No.: 10/548,056

(22) PCT Filed: Mar. 2, 2004

(86) PCT No.: PCT/CH2004/000116

§ 371 (c)(1),
(2), (4) Date: Apr. 21, 2006

(87) PCT Pub. No.: WO2004/079459

PCT Pub. Date: Sep. 16, 2004

(65) Prior Publication Data

US 2006/0181962 A1 Aug. 17, 2006

(30) Foreign Application Priority Data

Mar. 3, 2003 (CH) ..... 0320/03

(51) Int. Cl.
*G04B 15/00* (2006.01)
*G04B 17/00* (2006.01)

(52) U.S. Cl. ..... 368/127; 368/169

(58) Field of Classification Search ..... None
See application file for complete search history.

(56) References Cited

U.S. PATENT DOCUMENTS

| | | | | |
|---|---|---|---|---|
| 5,608,694 | A * | 3/1997 | Grimm et al. | 368/127 |
| 5,838,641 | A * | 11/1998 | Tohkoku et al. | 368/127 |
| 6,402,368 | B1 * | 6/2002 | Grimm et al. | 368/127 |
| 6,749,333 | B2 * | 6/2004 | Scheufele | 368/127 |

FOREIGN PATENT DOCUMENTS

| | | |
|---|---|---|
| CH | 694 831 A5 | 7/2005 |
| EP | 0 681 227 B1 | 11/1995 |
| EP | 0 727 721 A1 | 8/1996 |
| WO | WO 01/18611 A1 | 3/2001 |

OTHER PUBLICATIONS

International search report PCT/CH2004/000116 dated Sep. 22, 2004.

* cited by examiner

*Primary Examiner*—Vit W. Miska
(74) *Attorney, Agent, or Firm*—Ostrolenk, Faber, Gerb & Soffen, LLP

(57) ABSTRACT

The invention relates to a tourbillon (1) comprising a main bearing (22). A first bearing (18) of the balance axle (19) rotates with the platform (2) of the tourbillon (1), and a second bearing (26) of the balance axle (19) is arranged in a fixed manner.

11 Claims, 2 Drawing Sheets

TOURBILLON

CROSS REFERENCE TO RELATED APPLICATION

The present application is a 35 U.S.C. § 371 national phase conversion of PCT/CH2004/000116 filed 2 Mar. 2004, which claims priority of Swiss Patent Application 320/03 filed 3 Mar. 2003 is herein incorporated by reference.

The present invention relates to a tourbillon, respectively a tourbillon module, according to the preamble of the independent patent claim.

Clock movements with a tourbillon are known from the prior art. These are generally complicated in construction, with attendant disadvantages in manufacture, adjustment and maintenance.

EP 0 681 227 (EP'227) discloses a tourbillon arranged in the middle of the clock movement, mounted in front of a spring barrel. The tourbillon has a main bearing, serving to bear the entire rotating jig of the tourbillon and the components mounted thereon. With respect to installation and upkeep this structure is complicated and expensive.

In particular in the case of a defect it is necessary to uninstall the whole clock movement to gain access to the tourbillon. The tourbillon known from EP'227 has a comparatively difficult, complicated structure, which has a negative effect on accuracy due to the position of the centre of gravity. Since the inner ring of the main bearing is connected to the base of the tourbillon on one side and on the other side in the interior at the level of the base of the tourbillon platform has a bearing for bearing the balance axis, a relatively large, complicated ball bearing is required, which in addition has to be specially made.

Because it is known that special ball bearings are very expensive to manufacture and these can be ordered only in large quantities, this construction has considerable disadvantages with respect to precision and cost-effective manufacture. A further disadvantage, on account of the arrangement of the lower balance bearing, at the level of the platform of the tourbillon in the upper region of the inner ring of the bearing, is that the balance axis has only a comparatively minimal length, acting negatively on the mechanical stability and bearing forces. A further disadvantage is that both the main bearing of the tourbillon, and the lower bearing of the balance are not accessible when in the installed state, with the result that the whole clock must be dismantled for maintenance work.

Since 1993 the firm IWC, Schaffhausen, has been building a flying tourbillon with a one-sided ball bearing in the model "Il Destriero Scafusia". This has a rotating jig (tourbillon base), which is connected with the outer ring of the ball bearing. The inner ring of the bearing is fixed. Arranged above the ball bearing, at the level of the platform of the rotating jig, the lower balance bearing. A disadvantage of this construction is the complicated, nested structure, requiring a certain structural height.

For the lower region of the tourbillon to be accessible the entire tourbillon must be dismantled. A further disadvantage is that the tourbillon, in particular its bearings, are not accessible externally in the mounted state. Due to the arrangement of the relatively high weight and centre of gravity there are differences in the accuracy depending on the alignment of the tourbillon.

WO 01/18611 discloses a flying tourbillon with a main bearing. This tourbillon has a simple, modular structure and is distinguished by its high accuracy. The lower bearing of the balance axis is arranged inside a sleeve in the lower region, which is connected solidly with the rotating jig. The lower bearing of the balance axis is arranged substantially at the level of the main bearing of the tourbillon.

The object of the invention disclosed here is to further develop the tourbillon known from WO 01/18611 such that it has further improved, position-optimised accuracy. A further object is to show a tourbillon, which has improved robustness and a manufacture- and maintenance-friendly structure.

The inventive tourbillon preferably has a modular structure, wherein the actual tourbillon mechanism, including all essential parts, is assembled in a tourbillon module. The tourbillon module preferably has an interface to the rest of the clock movement and it can be easily placed into the latter from the front or behind, or taken out of it, without that the whole clock movement having to be dismantled.

The tourbillon has a platform, which is mounted one-sided (flying tourbillon), and on which are mounted the rotating components of the tourbillon, in particular balance, balance spring and escapement and the means required for mounting same.

A support can be provided in the dial region, if required.

For bearing the platform of the tourbillon preferably a standardised standard ball bearing is used, whereby cost-intensive special manufacturing can be dispensed with. The platform of the tourbillon has a main bearing axis, which is connected with an inner ring of the ball bearing, preferably detachably. The outer ring of the main bearing is connected with a base plate, serving as attachment for the tourbillon in a clock movement. The inner and/or outer ring of the main bearing are preferably structured such that the bearing clearance can be adjusted simply.

The disadvantage of tourbillon constructions known from the prior art usually is that adjusting and maintaining the tourbillon is not possible in the assembled state. In case such a tourbillon is to be maintained, the whole clock movement must be taken apart for this purpose.

The present invention enables this disadvantage to be prevented. The present tourbillon has a preferably modular structure, which enables the tourbillon to be detached partially or wholly from the rest of the clock movement. In addition, there is the possibility of arranging the bearings of the tourbillon such that they are accessible for maintenance purposes, without the whole tourbillon, respectively the clock movement, having to be taken apart. One possibility is to arrange the tourbillon such that it is visible from the front of the clock movement and can be maintained from the rear of the clock movement. The tourbillon, respectively the tourbillon module, is preferably arranged in an opening of the bottom plate of the clock movement, extending over the entire depth, that is, is interconnected. In another embodiment the tourbillon, respectively the tourbillon module, is placed into a not interconnected opening from the front or from behind, respectively can easily be taken out of same as a result of the modular structure. The platform of the tourbillon preferably has external teeth for engaging in a wheel work and is preferably the part with the greatest diameter, that is, determining for the diameter of the opening in the bottom plate of the clock movement.

The accuracy of a tourbillon is influenced by the mass of the mobile parts and their (total) centre of gravity. To minimise the total mass of the rotating part of the tourbillon, a lower bearing of a balance axis is arranged fixed.

The length of the balance axis is enlarged compared to a rotating bearing, which has a positive effect on the stability and robustness, respectively enables bearings of different sizes to be used.

Both the main bearing and the lower bearing of the balance are, in particular relative to one another, arranged preferably such that they are accessible without much trouble for maintenance and inspection purposes. The lower bearing of the balance and the main bearing of the platform of the tourbillon are preferably arranged substantially coaxial, since this deflects mechanical impacts and vibration. Through an arrangement of the lower balance bearing on a deeper plane, impact loads and vibrations are better absorbed. Finished bearings are preferably fastened by pressing, screwing, clamping or adhesion and are secured if required with appropriate securing means.

The invention will now be explained in greater detail by means of the embodiments illustrated in the following figures. In schematic and simplified form:

Figure 1:
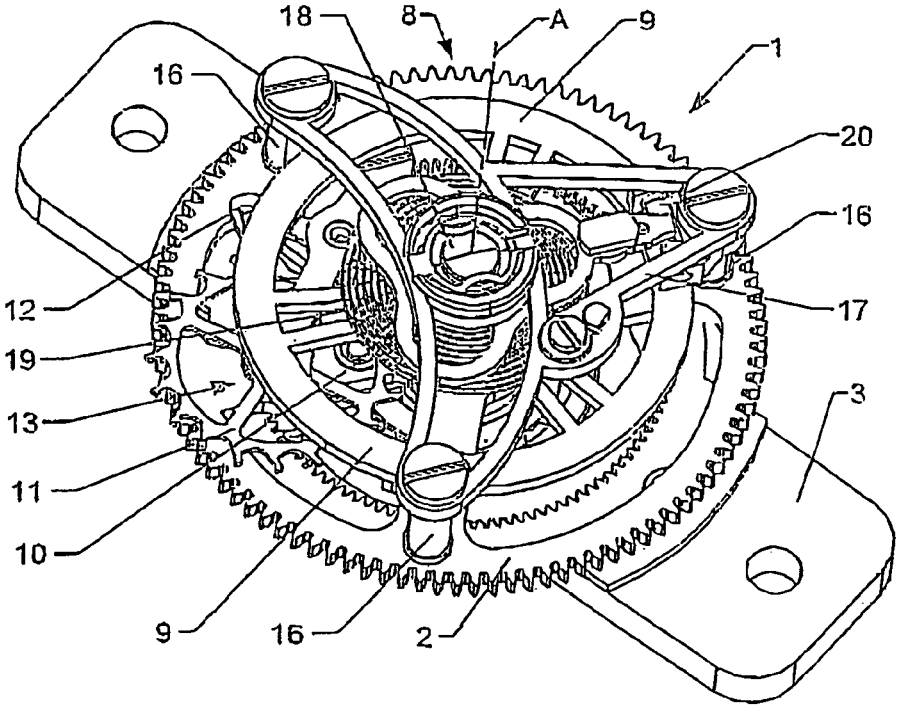
FIG. 1 shows a tourbillon module in a perspective view.

FIG. 1 shows a tourbillon in a perspective illustration. The construction of the tourbillon is a flying tourbillon, mounted on one side. The tourbillon is designed as tourbillon module 1, which is manufactured if required independently of the rest of the clock movement, adjusted if required and then mounted. The tourbillon module 1 has a platform 2, which is swivel-mounted on a base plate 3 about a centric axis A. The platform 2 has external teeth 8, by which the tourbillon module 1 is driven on the clock movement side, respectively the escapement of the clock movement is regulated. Arranged on the platform 2 coaxial to the axis A is a balance 9, connected to a spiral spring 10. The balance 9 is connected with an escape wheel 11 and an pallet 12 (only partially visible). The escape wheel 11 is attached to an escape wheel axis 13 (cf. FIG. 4). Arranged on the lower side of the platform 2 on the escape wheel axis 13 is a pinion 14, which combs with a dented wheel 15 fixed centrally on the axis A (cf. FIG. 2, respectively FIG. 4), attached to the base plate 3. Arranged on the platform 2 are three supports 16, which act to mount a main bridge 17. Evident in the middle of the main bridge 17 is an upper balance bearing 18, which serves as bearing for a balance axis 19 (cf. FIG. 4), on which the balance 9 is attached. A regulating mechanism 20 serves to fine-tune the accuracy.

Figure 2:
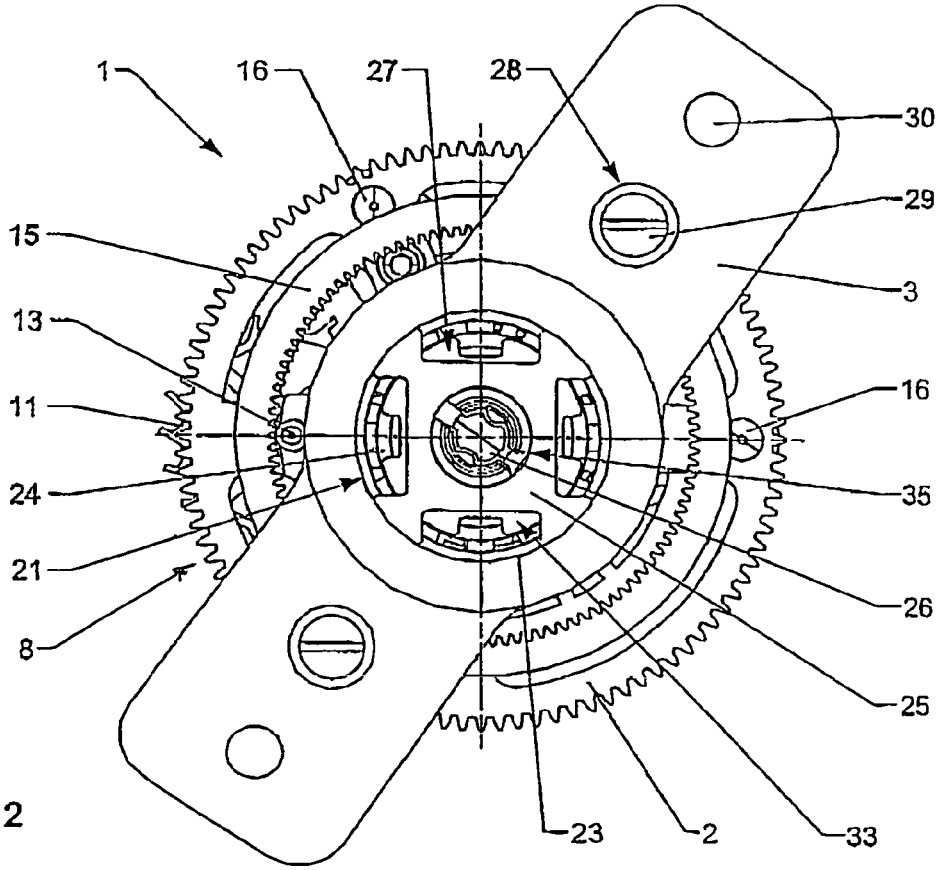
FIG. 2 shows the tourbillon module according to FIG. 1 in a rear view.

FIG. 2 shows the tourbillon module 1 of FIG. 1 in a rear view. The base plate 3 has a main opening 21, in which a main bearing 22 is arranged, which acts as bearing for the platform 2 of the tourbillon 1 opposite the base plate 3. The main bearing is a ball bearing 22, whereof the outer ring 23 is attached to the base plate 3. The inner ring 24 (cf. FIG. 4) is connected with the platform 2. In the illustration a balance bearing bridge 25, which partially covers the main bearing 22, is arranged in front of the main bearing 22, that is, under normal circumstances on the side facing away from the dial.

The balance bearing bridge 25 is arranged in the region of the opening 21 and in the centre has a lower balance bearing 26. In contrast to the upper balance bearing 18, which is connected with the platform 2 and rotates with the latter, the lower balance bearing 26 is arranged fixed and does not describe a rotary movement. The balance bearing bridge 25, here somewhat similar to a Maltese cross, has four radial recesses 27 arranged on the periphery, which free up the view of the main bearing 22 arranged behind this. Through this opening there is the possibility of checking the main bearing 22.

The balance bearing bridge 25 is pressed here into the opening 21. Alternatively, there is the possibility of attaching the balance bearing bridge 25 by means of a screw, a clamp or an adhesive connection. It is evident in the illustrated view how the pinion 14 attached to an escape wheel axis 13 combs with the dented wheel 15 centred on the axis A. Seen on the platform 2 are two of the three supports 16 in rear view, which act as mounting for the main bridge 17 of the tourbillon 1. The supports 16 are pressed into the base 2. The base plate 3 has two first fastening openings 30, which act to fasten the tourbillon module 1 in a clock movement (not shown in greater detail). In two second openings 28 two fastening screws 29 are arranged, which act to fasten the dented wheel 15 on the base plate 3.

Figure 3:
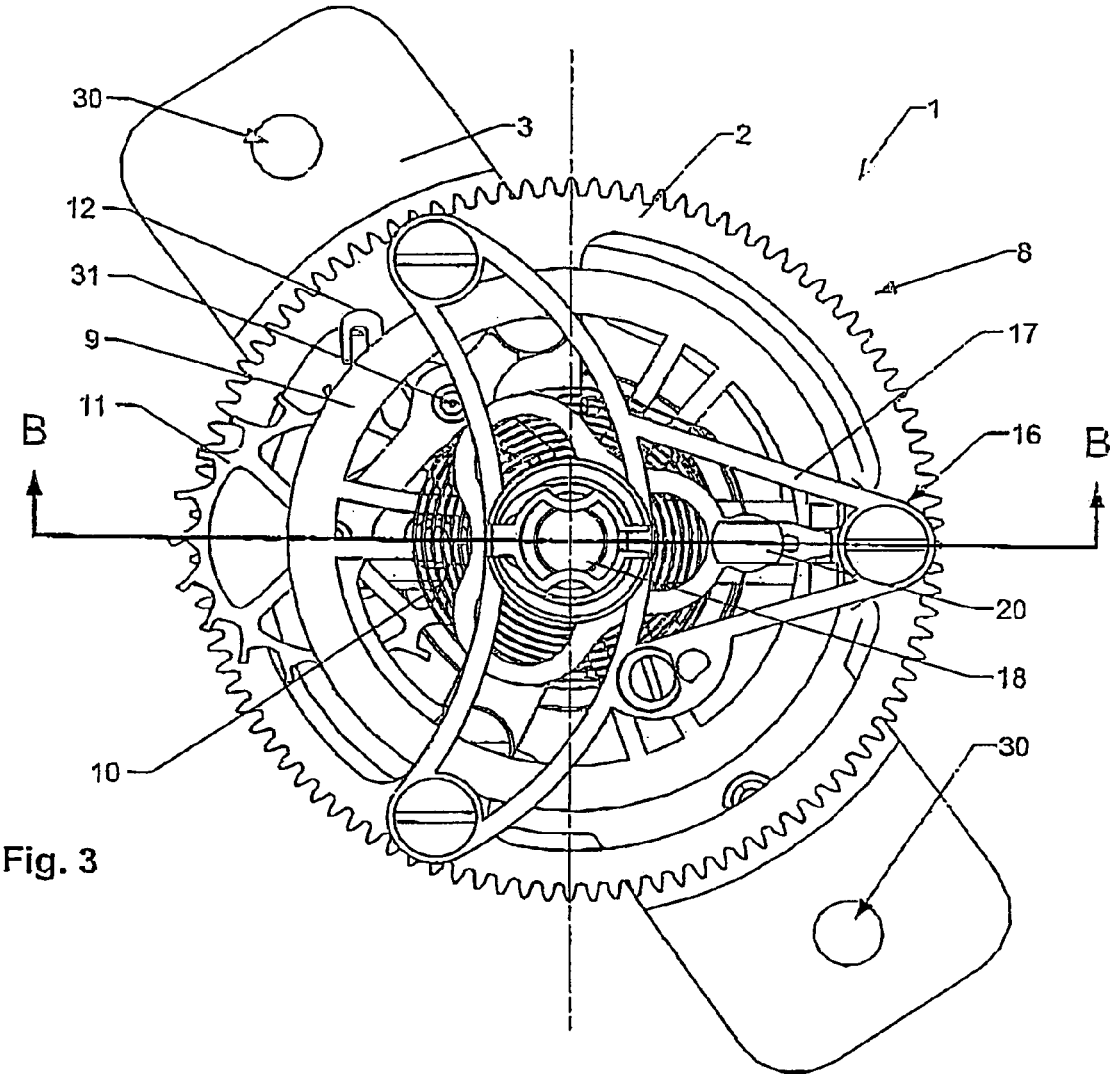
FIG. 3 shows the tourbillon module in FIG. 1 in a plan view.

FIG. 3 shows a plan view of the tourbillon 1. Evident on the platform 2 is the balance 9 arranged substantially coaxial to the axis A. In the illustrated embodiment the spiral spring 10 is connected at its inner end with the balance 9 and at its outer end with the main bridge 17, respectively the regulating mechanism 20. The balance 9 is connected with the escape wheel 11 and the pallet 12, which is arranged to rotate about a pallet axis 31. Both the escape wheel axis 13 and the escape wheel axis 30 are in mounted bearings connected on the platform 2, respectively the main bridge 17. On the platform 2 the three supports 16 are arranged, on which the main bridge 17 are fastened by means of screw connections 31. In the middle of the main bridge 17 the upper balance bearing 18 is arranged.

Figure 4:
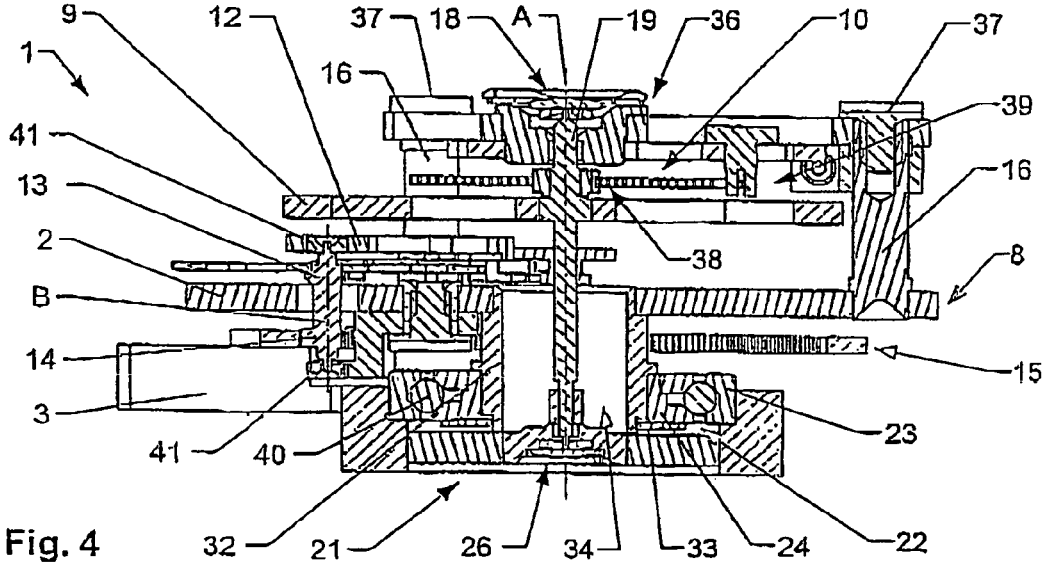
FIG. 4 shows a section through the tourbillon module according to FIG. 3.

FIG. 4 shows a section through the tourbillon module 1 according to FIG. 3 along the intersection line BB. The platform 2 of the tourbillon has a platform main axis 32 with a centric opening 34. The platform main axis 32 is formed here by a platform sleeve 32, which is connected solidly with the platform 2. If required, these can be formed monobloc. On the platform sleeve 32 the inner ring 24 of the main bearing 22 is set and secured with a securing ring 33. In the illustrated embodiment the connection between the inner ring 24 and the platform sleeve 32 is detachable, enabling easy mounting/disassembling. In certain embodiments the platform sleeve 32 can also form the inner ring of the bearing. Visible between the inner ring 24 and the outer ring 23 are spheres 40 of the ball bearing. The outer ring 23 of the main bearing 22 is pressed into the main opening 21 of the base plate 3.

The platform sleeve 32 has an interconnected opening 34, in which the balance axis 19 is arranged. The balance axis 19 is mounted at its end shown at the top in the illustration by an upper balance bearing 18 and at its lower end is mounted radial and axial in a lower balance bearing 26, so that it can rotate freely about its axis A. The balance bearings 18, 26 are two bearing blocks, whereof one is responsible for the axial bearing and the other for the radial bearing. The lower balance bearing 26 is arranged outside the platform 2 on the fixed side and rotates in contrast to the upper balance bearing 19 not with the platform 2. In the illustrated embodiment there is no direct connection between the platform sleeve 32 and the lower balance bearing 26. The lower balance bearing 26 is arranged in a balance bearing bridge opening 35 of the balance bearing bridge 25.

In the illustrated embodiment the balance bearing bridge 25 is pressed into the cylindrical main opening 21. Other fastening means are possible. The upper balance bearing 18 is here pressed into a main bridge opening 36 of the main bridge 17, which are attached via three supports 16 (two of which are visible) on the platform 2. The main bridge 17 is screwed detachably via fastening screws 37 with the supports 16. Other fastening means are possible. Due to the arrangement of the balance bearing 18, 26 the balance axis 19 has a comparatively maximum length. This has positive effect on the load of the balance bearing 18, 26. Also, the bearing loads of the lower balance bearing 26 are not deflected via the main bearing.

Arranged on the balance axis 19 is the balance 9. The spiral spring 10 is connected in the region of its inner end 38 with the balance 9 and in the region of its outer end 39 with a regulating mechanism 20, respectively the platform 2. The balance 9 is connected via a pallet 12 with an escape wheel 11. The escape wheel 11, and a pinion 14 are connected rigidly to one another via an escape wheel axis 13 and are mounted rotatably about the latter. The escape wheel axis 13 is mounted in two pallet wheel bearings 41. The pinion 14 engages in the internal teeth of the dented wheel 15. When the platform 2 of the tourbillon and the parts mounted thereon revolve about the axis A of the main bearing 22, the pinion 14 is rotated and with it the escape wheel 14 about its axis B, the result of which is that the balance is driven again via the connected pallet 11, respectively stopped. The rotary motion of the platform 2 about the axis A is thus regulated.

With the embodiment described the lower balance bearing is arranged outside the platform. The mass rotating in the tourbillon is reduced, which has a positive effect on precision and accuracy.

The invention claimed is:

1. A tourbillon (1) with a base plate (3), a main bearing (22) and a platform (2) with a platform main axis (32), characterised in that an inner ring (24) of the main bearing (22) is connected with the platform main axis (32) of the tourbillon (1) and an outer ring (23) of the main bearing (22) is connected with the base plate (3) of the tourbillon, and that an upper balance bearing (18) is connected with the platform (2) and a lower balance bearing (26) is connected with the base plate (3), and that the platform main axis (32) has an opening (34), in which a balance axis (19) is arranged.

2. The tourbillon (1) as claimed in claim 1, characterised in that the main bearing (22) is a ball bearing (22).

3. The tourbillon (1) as claimed in claim 1, characterised in that the platform main axis is formed by a platform sleeve (32).

4. The tourbillon (1) as claimed in claim 1, characterised in that the lower balance bearing (26) and the main bearing (22) are arranged such that they are accessible in the assembled state for maintenance and checking purposes.

5. A tourbillon module (1) with a tourbillon as claimed in claim 1.

6. The tourbillon (1) as claimed in claim 2 characterised in that the platform main axis is formed by a platform sleeve (32).

7. The tourbillon (1) as claimed in claim 2, characterised in that the lower balance bearing (26) and the main bearing (22) are arranged such that they are accessible in the assembled state for maintenance and checking purposes.

8. The tourbillon (1) as claimed in claim 3, characterised in that the lower balance bearing (26) and the main bearing (22) are arranged such that they are accessible in the assembled state for maintenance and checking purposes.

9. A tourbillon module (1) with a tourbillon as claimed in claim 2.

10. A tourbillon module (1) with a tourbillon as claimed in claim 3.

11. A tourbillon module (1) with a tourbillon as claimed in claim 4.

* * * * *